US008160487B2

(12) United States Patent
Hashimoto

(10) Patent No.: US 8,160,487 B2
(45) Date of Patent: Apr. 17, 2012

(54) IMAGE-FORMING DEVICE HAVING FIRST AND SECOND SHEET GUIDE PAIRS FOR GUIDING SHEETS OF DIFFERENT SIZES

(75) Inventor: Yohei Hashimoto, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 788 days.

(21) Appl. No.: 12/269,522

(22) Filed: Nov. 12, 2008

(65) Prior Publication Data

US 2009/0142111 A1 Jun. 4, 2009

(30) Foreign Application Priority Data

Nov. 21, 2007 (JP) ..... 2007-301784

(51) Int. Cl.

| | |
|---|---|
| ***B65H 5/06*** | (2006.01) |
| ***B65H 5/36*** | (2006.01) |
| ***B65H 5/38*** | (2006.01) |
| ***G03G 15/20*** | (2006.01) |

(52) U.S. Cl. ..... 399/400; 399/322; 399/68

(58) Field of Classification Search ..... 399/400, 399/322, 397, 68

See application file for complete search history.

(56) References Cited

U.S. PATENT DOCUMENTS

| | | | | |
|---|---|---|---|---|
| 2002/0176726 | A1* | 11/2002 | Ohuchi et al. | 399/400 |
| 2006/0210306 | A1* | 9/2006 | Okamoto | 399/119 |
| 2009/0003910 | A1* | 1/2009 | Kobayashi | 399/400 |
| 2010/0086334 | A1* | 4/2010 | Sakaya | 399/328 |

FOREIGN PATENT DOCUMENTS

| | | |
|---|---|---|
| JP | 5-289450 | 11/1993 |
| JP | 5-323814 | 12/1993 |
| JP | HEI-8-44230 | 2/1996 |
| JP | 2006-308753 | 11/2006 |
| JP | 2007-169034 | 7/2007 |

OTHER PUBLICATIONS

Japanese Office Action dated Oct. 12, 2010 with English translation.
Japanese Office Action dated Oct. 13, 2009 with English translation.

* cited by examiner

*Primary Examiner* — Leslie J Evanisko
(74) *Attorney, Agent, or Firm* — Scully, Scott, Murphy & Presser, P.C.

(57) ABSTRACT

The image-forming device includes an image-forming unit, a fixing unit, a pair of first guides, and a pair of second guides. A sheet conveying path is provided from the image-forming unit to the fixing unit. The pair of first guides are disposed on the conveying path and configure to contact with an image-forming side of the recording sheet at both widthwise edges thereof, for restraining the recording sheet from being displaced toward the image-forming side. The pair of second guides are disposed on the conveying path and configure to contact with the image-forming side of the recording sheet at both widthwise edges thereof for restraining the recording sheet from being displaced toward the image-forming side, a distance between the pair of first guides in the widthwise direction being greater than a distance between the pair of second guides in the widthwise direction.

12 Claims, 10 Drawing Sheets

IMAGE-FORMING DEVICE HAVING FIRST AND SECOND SHEET GUIDE PAIRS FOR GUIDING SHEETS OF DIFFERENT SIZES

CROSS REFERENCE TO RELATED APPLICATIONS

This application claims priority from Japanese Patent Application No. 2007-301784 filed Nov. 21, 2007. The entire content of this priority application is incorporated herein by reference.

TECHNICAL FIELD

The present invention relates to an electrophotographic type image-forming device.

BACKGROUND

An electrophotographic type image-forming device well known in the art has an image-forming unit for transferring developing agent images onto paper or another recording sheet, and a fixing unit for heating the recording sheet to fix the developing agent images to the recording sheet. However, the developer can easily separate from the recording sheet while the sheet is being conveyed along the conveying path from the image-forming unit to the fixing unit.

Further, if the region in which the fixing unit pinches the recording sheet (nip point) is set at a position offset vertically from a direction in which the recording sheet is discharged from the image-forming unit, for example, a trailing edge of the recording sheet in the conveying direction flips upward sharply when the recording sheet is discharged from the image-forming unit.

The impulse of the trailing edge of the recording sheet flipping upward can cause unfixed developing agent to separate from the recording sheet, reducing the quality of the image formed on the recording sheet.

An image forming device disclosed in Japanese patent application publication No. HEI-8-44230 provides entry guides on an entrance side of the fixing unit for preventing the trailing edge of the recording sheet from flipping upward. In order to support various paper sizes, this device has a plurality of entry guides offset from each other in the thickness direction of the recording sheet to support each paper size, the entry guides being configured to hold down both widthwise edges of the recording sheet in an attempt to cope with the sheets of various size.

However, the plurality of entry guides provided for each paper size in this conventional device are offset in the thickness direction of the recording sheet but disposed at the same position in the conveying direction. Accordingly, if the recording sheet conveyed to the fixing unit were bent to form a convex shape protruding in the thickness direction and extending along the longitudinal direction, for example, the entry guides provided for a smaller sheet size than the current recording sheet being conveyed would contact the recording sheet at positions closer to the center of the sheet than the widthwise edges, resulting in the entry guides rubbing against developing agent carried on the recording sheet.

Hence, the developing agent carried on the recording sheet would be separated from the sheet by the rubbing of the entry guides, reducing the quality of the image formed on the recording sheet.

SUMMARY

In view of the foregoing, it is an object of the present invention to effectively restrain the trailing edge from flipping upward on recording sheets of a plurality of sizes.

In order to attain the above and other objects, the invention provides an image-forming device for forming an image on a recording sheet. The image-forming device includes an image-forming unit, a fixing unit, a pair of first guides, and a pair of second guides. The recording sheet defines a width in a direction perpendicular to a sheet conveying direction. The image-forming unit forms a developing agent image on the recording sheet. The fixing unit includes a heating and a pressure roller. The heating roller heats the recording sheet discharged from the image-forming unit. The pressure roller presses the recording sheet against the heating roller. The heating roller and the pressure roller provide a nip point where the recording sheet is nipped therebetween. The nip point is offset in a thickness direction of the recording sheet from a plane along which the recording sheet is discharged from the image-forming unit. A sheet conveying path is provided from the image-forming unit to the fixing unit. The pair of first guides dispose on the conveying path and configure to contact with an image-forming side of the recording sheet at both widthwise edges thereof, for restraining the recording sheet from being displaced toward the image-forming side. The pair of second guides dispose on the conveying path and configure to contact with the image-forming side of the recording sheet at both widthwise edges thereof for restraining the recording sheet from being displaced toward the image-forming side, a distance between the pair of first guides in the widthwise direction being greater than a distance between the pair of second guides in the widthwise direction, and the pair of second guides being offset from the pair of first guides in the sheet conveying direction.

BRIEF DESCRIPTION OF THE DRAWINGS

The particular features and advantages of the invention as well as other objects will become apparent from the following description taken in connection with the accompanying drawings, in which.

DETAILED DESCRIPTION

An image-forming device according to one embodiment of the present invention will be described with reference to FIGS. 1 though 10. The image forming device is a laser printer connected to a computer.

Figure 1:
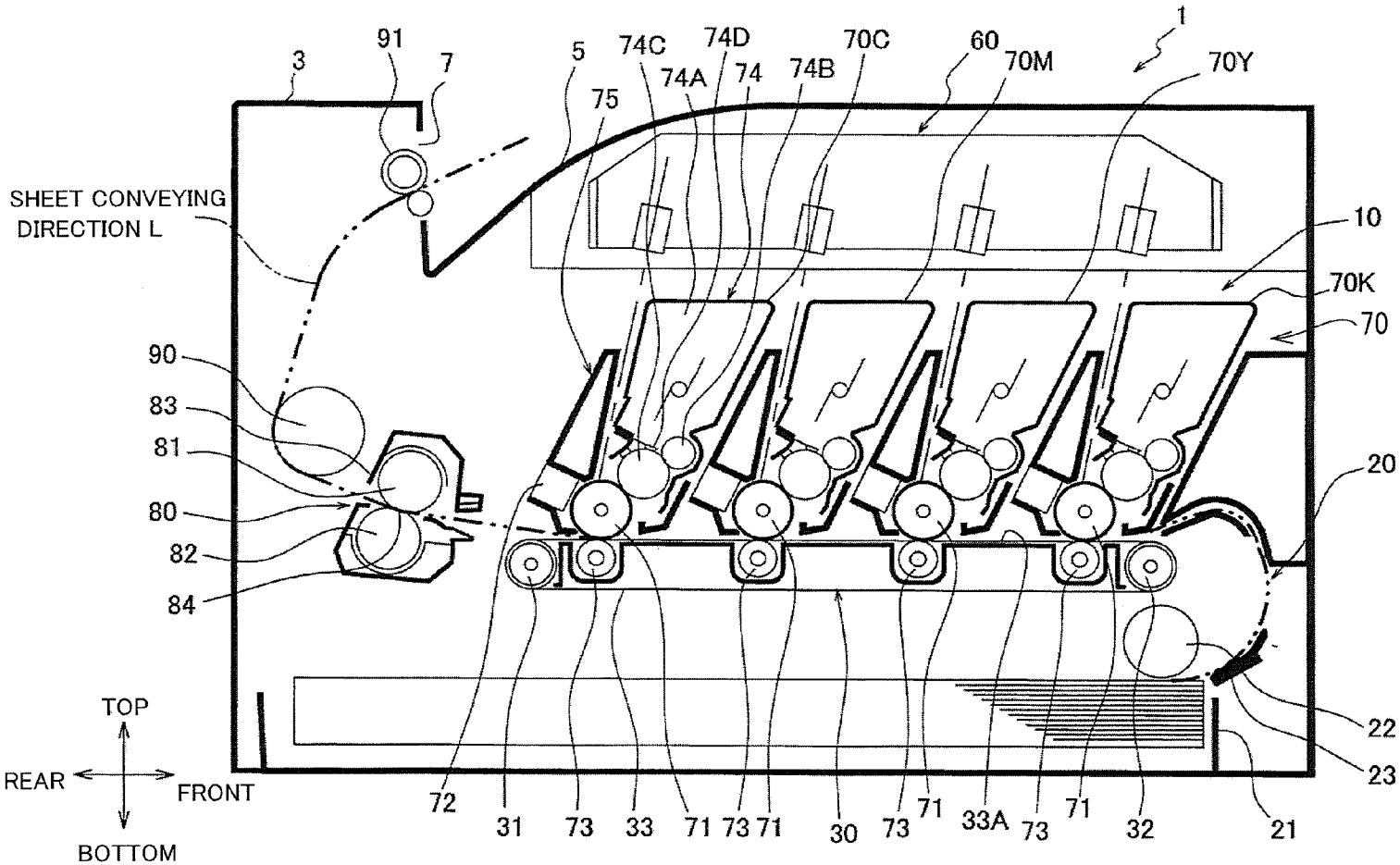
FIG. 1 is a schematic side cross-sectional view showing the principal structure of an image-forming device according to one embodiment of the present invention.
Figure 2:
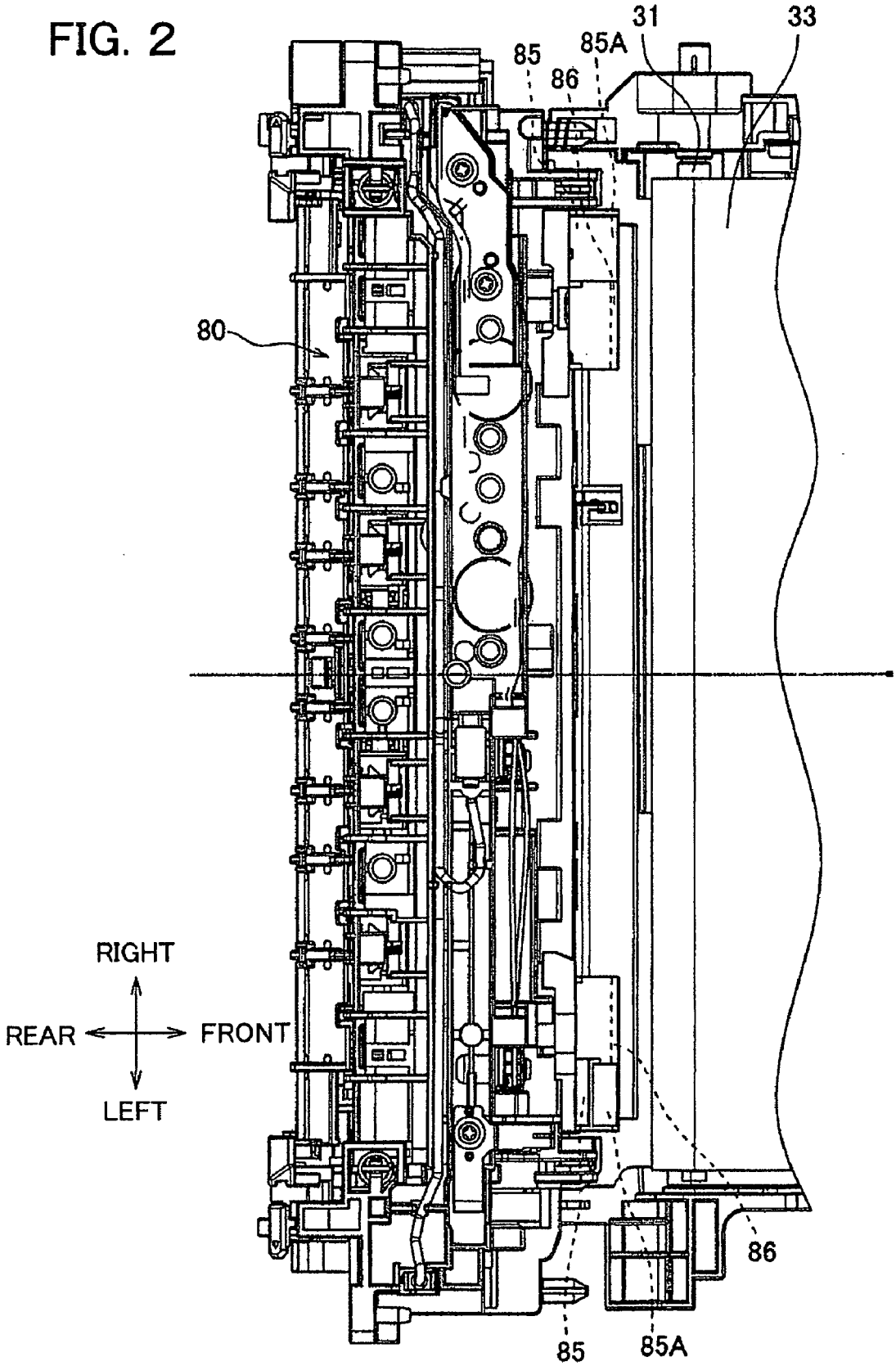
FIG. 2 is a top view of the image-forming device around a fixing unit in the image forming device according to the embodiment.
Figure 3:
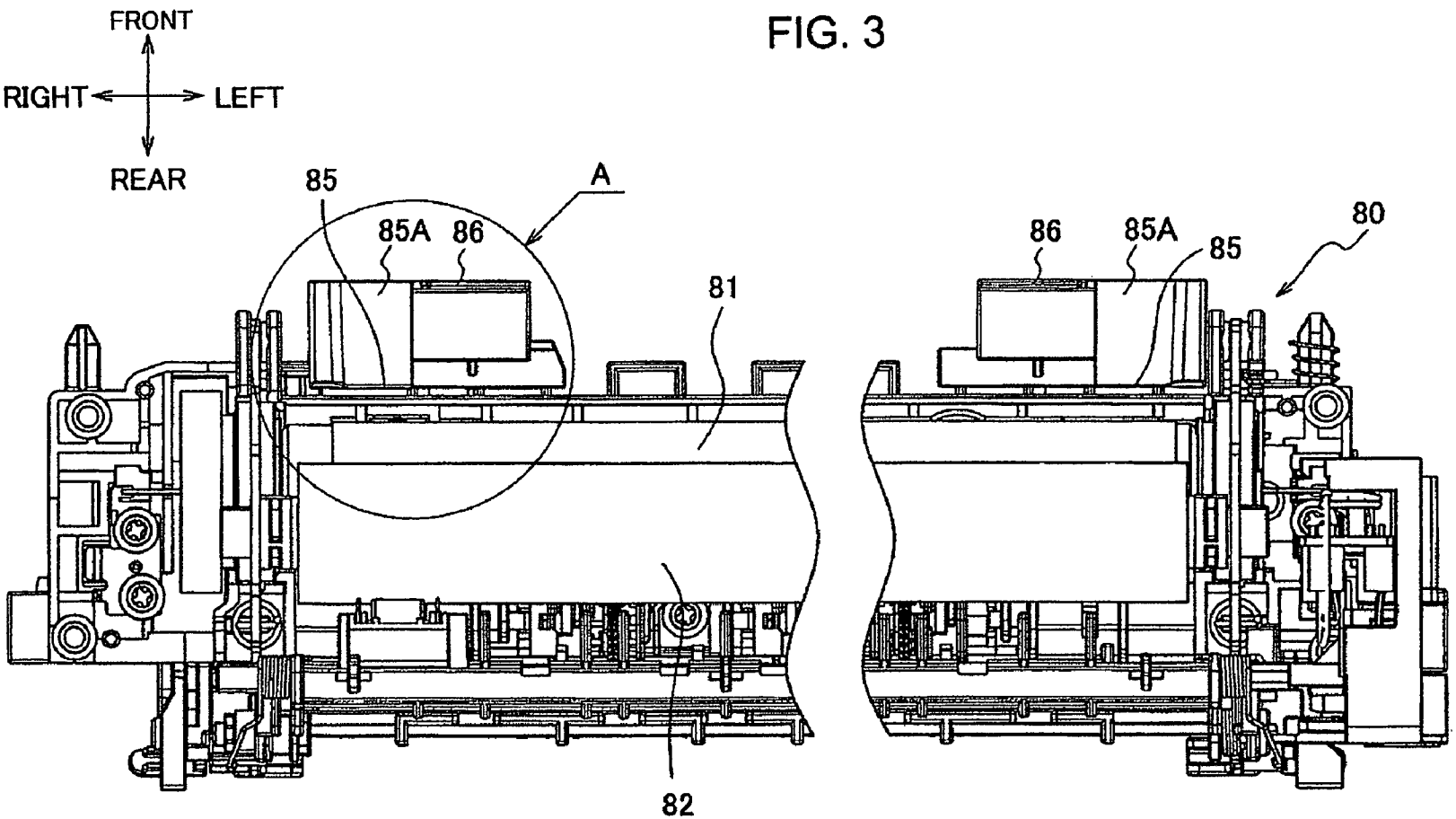
FIG. 3 is a bottom view of the fixing unit.

In FIG. 1, an image-forming device 1 according to the embodiment is oriented such that an upper contour will be referred to as a top side and a right side will be referred to as the "front side." The terms "above", "below", "front", "rear"

will be used throughout the description assuming that the laser printer is dispose in an orientation in which it is intended to be used.

The image-forming device 1 has a casing 3 forming a main body of the device. A discharge tray 5 is provided on the top surface of the casing 3 for receiving and holding sheets, such as paper sheets and OHP sheets (hereinafter simply referred to as "sheet") discharged from the casing 3 after printing. The casing 3 is formed with a discharge opening 7 at a position immediate upstream of the discharge tray 5.

Frame members (not shown) formed of metal, synthetic resin, or the like are provided on the inside of the casing 3. An image-forming unit 10, a conveying unit 30, a fixing unit 80, and the like described later are detachably mounted on the frame members.

The image-forming unit 10 is provided substantially in the center of the casing 3 for forming images on a sheet, and includes four toner cartridges 70K, 70Y, 70M, and 70C. A feeding unit 20 is provided for supplying a sheet to the image-forming unit 10, and the conveying unit 30 is adapted for moving a sheet past the image-forming unit 10.

The image-forming device 1 further includes an intermediate conveying roller 90, a discharge chute (not shown) and a discharge roller 91. The intermediate conveying roller 91 is disposed downstream of the fixing unit 80, and the discharge chute is adapted for guiding the sheet upward and back toward the front along the sheet conveying direction L as shown in FIG. 1. The discharge roller 91 is adapted for discharging the sheet from the casing 3 through the discharge opening 7 onto the discharge tray 5.

The feeding unit 20 will be described in detail. The feeding unit 20 includes a sheet tray 21 accommodated in a bottom-most section of the casing 3, a feeding roller 22 disposed above the front end of the sheet tray 21 for feeding sheet from the sheet tray 21 to the image-forming unit 10, and a separating pad 23 for separating the an uppermost sheet from a sheet stack on the sheet tray 21 by applying a prescribed resistance to the uppermost sheet so that one sheet is fed at a time individually.

A U-shaped conveying path is provided in the front end of the casing 3 for guiding the sheet fed by the feeding roller 22 from the sheet tray 21 toward the image-forming unit 10.

Details of the conveying Unit 30 will be described. The conveying unit 30 includes a drive roller 31 that is rotated in association with the operations of the image-forming unit 10, a follower roller 32 rotatably disposed at a position away from the drive roller 31, and an endless conveying belt 33 stretched around the drive roller 31 and follower roller 32. The endless conveying belt 33 includes a one way running section 33A stretched between the pair of rollers 31 and 32 with a prescribed tension.

The conveying belt 33 is adapted for conveying sheet received from the feeding unit 20 toward the fixing unit 80 while the sheet rests on a top surface of the one way running section 33A of the conveying belt 33.

The drive roller 31 is rotatably supported in a frame (not shown) of the conveying unit 30, with a rotation axis of the drive roller 31 being immovable, while the follower roller 32 is rotatably supported in the frame with a rotation axis thereof being movable. The follower roller is biased by a spring (not shown) in a direction away from the drive roller 31 so as to apply the prescribed tension to the conveying belt 33.

Details of the image-forming unit 10 will be described. The image-forming unit 10 is a direct tandem-type unit capable of printing color images, and includes a scanning unit 60, and a drawer unit 70.

The scanning unit 60 is an exposure device disposed in an upper section of the casing 3 for forming an electrostatic latent image on each surface of a photosensitive drum 71 provided in each of the toner cartridges 70K, 70Y, 70M, and 70C respectively. Specifically, the scanning unit 60 includes laser light sources, a polygon mirror, fθ lenses, and reflecting mirrors.

Each laser light source emits a laser beam based on image data. The laser beam is deflected at the polygon mirror, and then passes through the fθ lens.

Then, the direction of an optical path is changed by the reflecting mirror, and is again changed downwards by another reflection mirror, so that the beam is irradiated on the surface of the corresponding photosensitive drum 71, to form an electrostatic latent image thereon.

The drawer unit 70 includes the four toner cartridges 70C, 70Y, 70M, and 70C, and a slidable casing 75 for accommodating these toner cartridges. The slidable casing 75 is supported on rails (not shown) provided on the frame members of the casing 3 and is movable in a horizontal direction (front-to-rear direction in FIG. 1).

The four toner cartridges 70K, 70Y, 70M, and 70C are arrayed in series along the sheet-conveying direction and correspond to the four toner colors black, yellow, magenta, and cyan in order from the upstream side in the sheet-conveying direction. The toner cartridges 70K, 70Y, 70M, and 70C directly transfer each toner image in onto the sheet in a superposed fashion.

Specifically, the toner cartridges 70K, 70Y, 70M, and 70C are provided with the photosensitive drums 71 each facing with the top surface of the one way running section 33A of the conveying belt 33. Each photosensitive drum 71 has a rotation axis extending in a direction perpendicular to the running direction of the conveying belt 33.

Since the toner cartridges 70K, 70Y, 70M, and 70C all have the same structure except only in the color of toner accommodated therein, only the structure of one toner cartridge, the cyan toner cartridge 70C will be described below.

The cyan toner cartridge 70C is detachably mounted in the casing 3 below the scanning unit 60. The cyan toner cartridge 70C includes the photosensitive drum 71, a charger 72, and a toner-accommodating unit 74.

The photosensitive drum 71 serves as an image bearing member to carry an image on a surface thereof. The photosensitive drum 71 is a cylindrical member whose outer surface is coated with a positive-charging photosensitive layer formed of polycarbonate.

The charger 72 functions to charge the surface of the photosensitive drum 71. The charger 72 is disposed diagonally above and rearward of the photosensitive drum 71, opposing the photosensitive drum 71, but is spaced away by a prescribed distance therefrom.

The charger 72 is a Scorotron charger having a charging wire formed of tungsten for producing a corona discharge and functions to charge the surface of the photosensitive drum 71 with a substantially uniform positive polarity.

A transfer roller 73 is rotatably disposed at a position immediately below the one way running section 33A and opposing the photosensitive drums 71, so that the sheet is interposed between the conveying belt 33 and photosensitive drums 71. The transfer roller 73 functions to apply a charge of opposite polarity to the charge of the photosensitive drums 71 to the side of the sheet opposite the image-forming surface, causing the toner deposited on the surface of the photosensitive drums 71 to be transferred onto the image-forming surface side of the sheet.

The toner-accommodating unit 74 includes a toner-accommodating chamber 74A for accommodating toner and a toner supply roller 74B and a developing roller 74C for supplying toner to the corresponding photosensitive drum 71. A thickness-regulating blade 74D is provided for regulating the thickness of toner carried on the surface of the photosensitive drum 71.

With this construction, the toner supply roller 74B rotates to supply toner accommodated in the toner-accommodating chamber 74A onto the developing roller 74C. The toner carried on the surface of the developing roller 74C is regulated to a prescribed uniform thickness by the thickness-regulating blade 74D. Subsequently, the layer of toner carried by the developing roller 74C is supplied to the surface of the photosensitive drum 71 that has been exposed to the light by the scanning unit 60.

The fixing unit 80 is detachably mounted in the frame members described earlier at a position immediate downstream of the image-forming unit 10 with respect to the sheet-conveying direction. The fixing unit 80 functions to fix the toner image formed on the sheet upon thermally melting and solidifying the toner image.

The fixing unit 80 includes a heating roller 81, a pressure roller 82, and a casing 83. The heating roller 81 is disposed on the image-forming surface side of the sheet and applies a conveying force to the sheet while heating the toner. The pressure roller 82 is disposed on the opposite side of the sheet from the heating roller 81 for pressing the sheet against the heating roller 81. The casing 83 accommodates the heating roller 81, and the pressure roller 82. The heating roller 82 has an inflection point. The widthwise center of the heating roller 82 forms the inflection point and widthwise edge portions are sloped. A diameter of widthwise center portion of the heat roller is smaller than the widthwise edge portion thereof.

Figure 9:
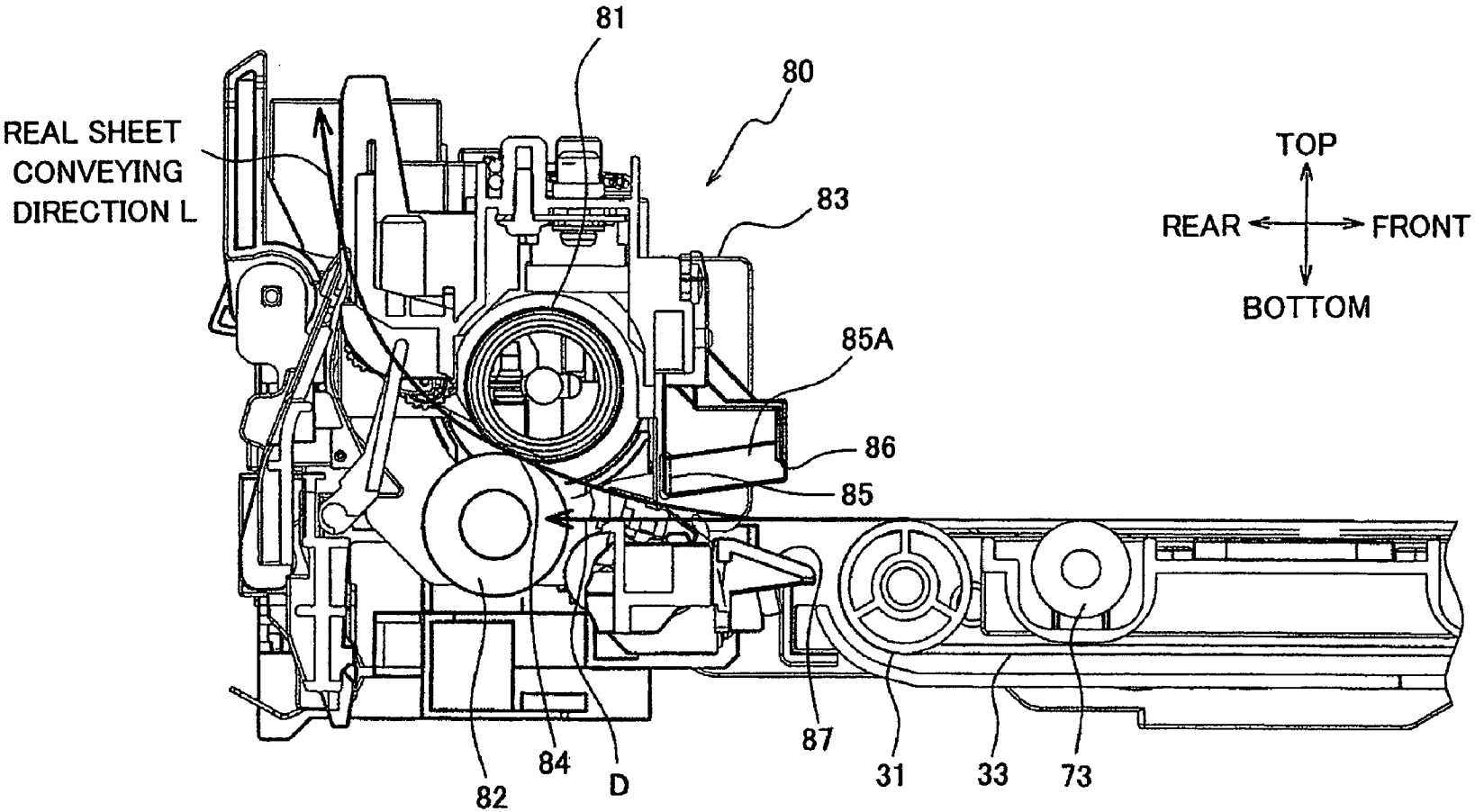
FIG. 9 is a side view illustrating the positional relationship between a conveying belt and the fixing unit in the image forming device according to the embodiment.

As shown in FIG. 9, a nip point 84 in the fixing unit 80 at which the heating roller 81 and pressure roller 82 grip the sheet is set to a position offset above a discharge level extending in a discharge direction D in which the sheet is discharged from the image-forming unit 10. That is, the nip point 84 is higher than the upper surface of the one way running section 33A.

Here, the "nip point 84" is the area that the heating roller 81 and pressure roller 82 pinch the sheet. Further, the "widthwise direction of the sheet" is a direction orthogonal to the thickness direction of the sheet and to the conveying direction; and the "discharge direction D in which the sheet is discharged from the conveying unit 30" is the direction that sheet would be discharged from the conveying unit 30 without any directional deviation.

Figure 5:
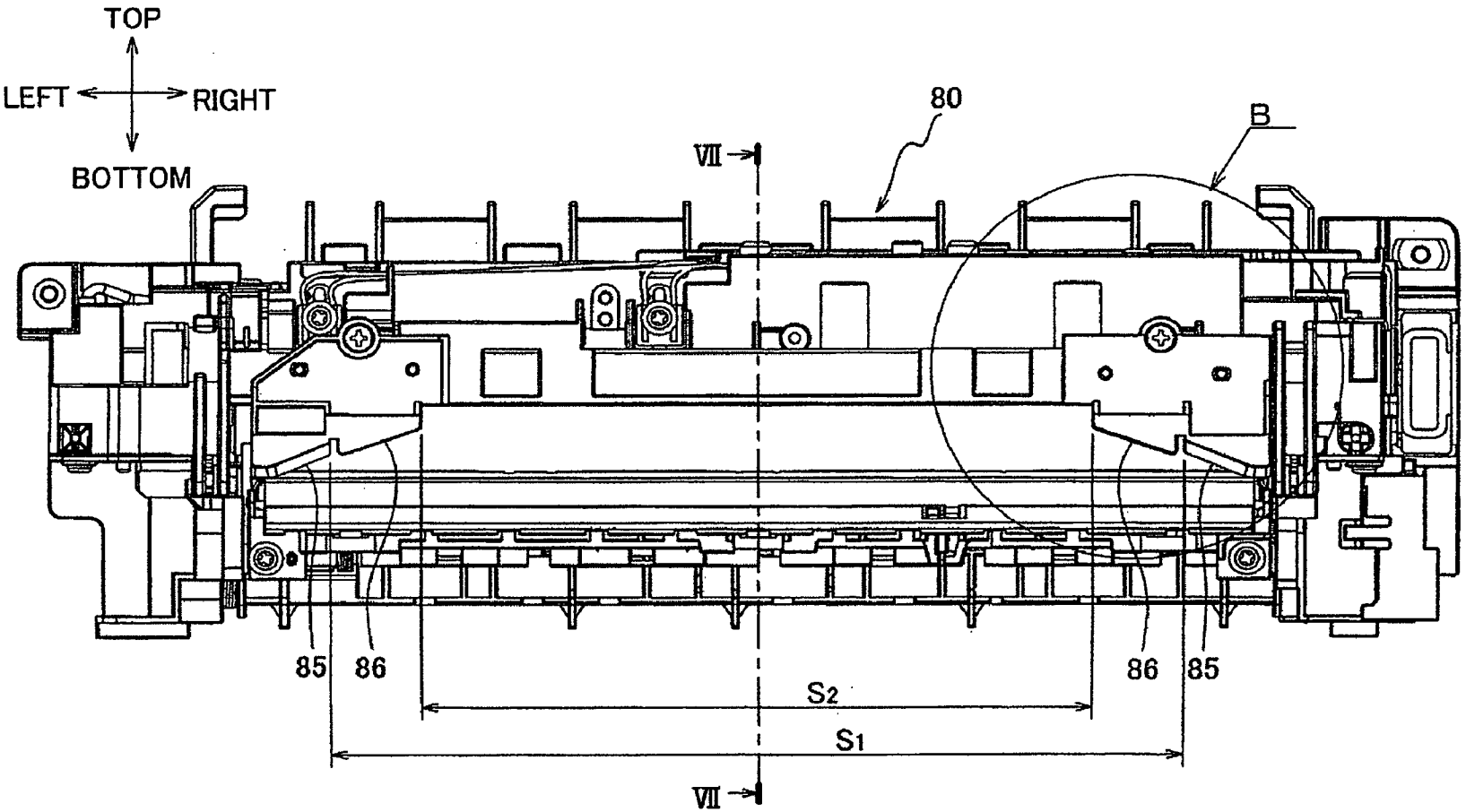
FIG. 5 is a front view of the fixing unit as viewed from the conveying unit side.
Figure 6:
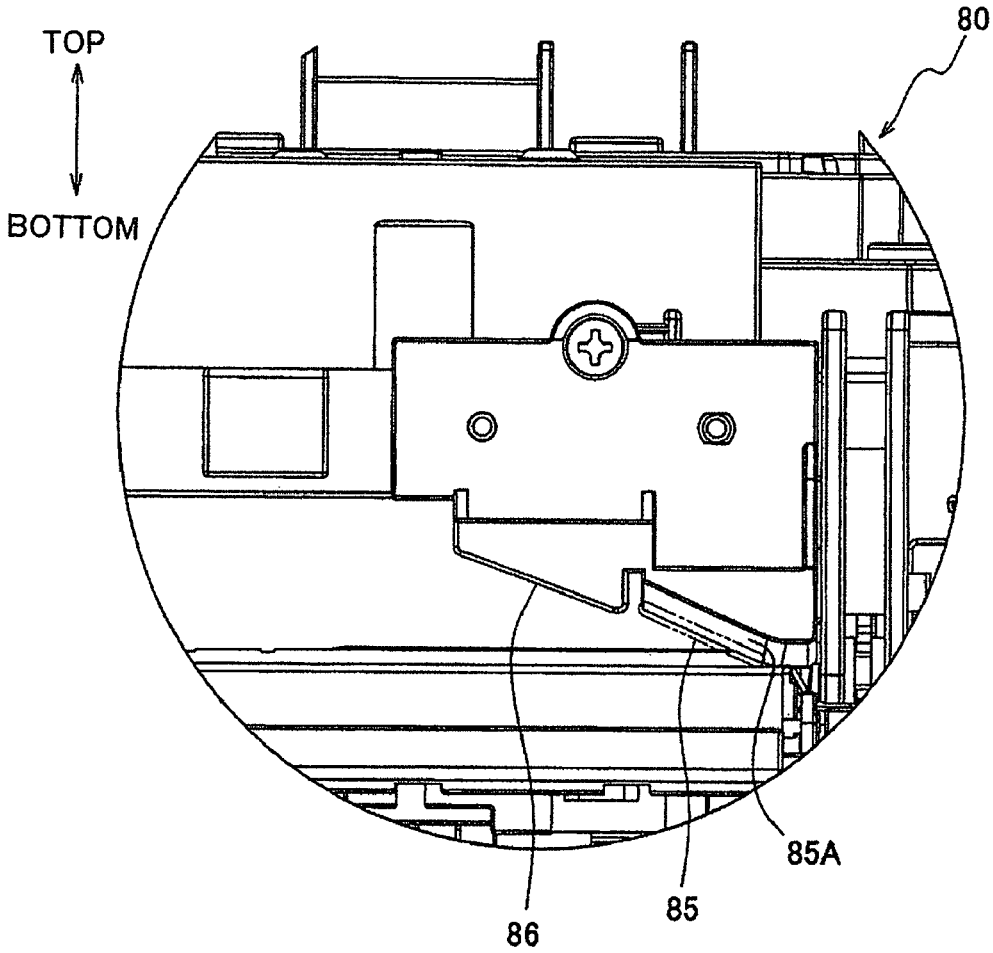
FIG. 6 is an enlarged view of a region A in FIG. 5.

As shown in FIG. 5, a pair of first restraining parts 85 and a pair of second restraining parts 86 are provided at the sheet entrance to the fixing unit 80, i.e., along the sheet-conveying path L (see FIGS. 7 and 9) leading from the image-forming unit 10 to the fixing unit 80.

The first and second restraining parts 85 and 86 are guide parts that restrict displacement of the sheet toward the side of the image-forming surface (top surface) by contacting the image-forming surface on both widthwise edge portions of the sheet.

As shown in FIG. 5, the first restraining parts 85 are spaced at a distance S1 greater than a distance S2 between the second restraining parts 86. Therefore, the second restraining parts 86 are positioned closer toward the widthwise center than the first restraining parts 85.

Figure 4:
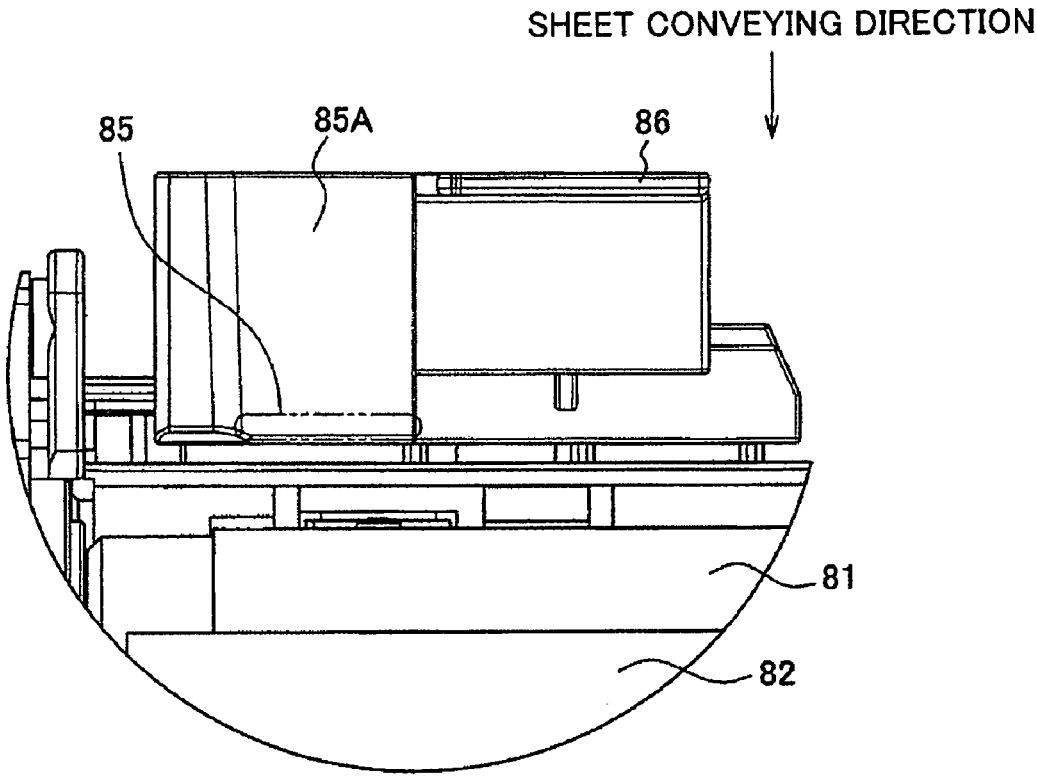
FIG. 4 is an enlarged view of a region A in FIG. 3.
Figure 8:
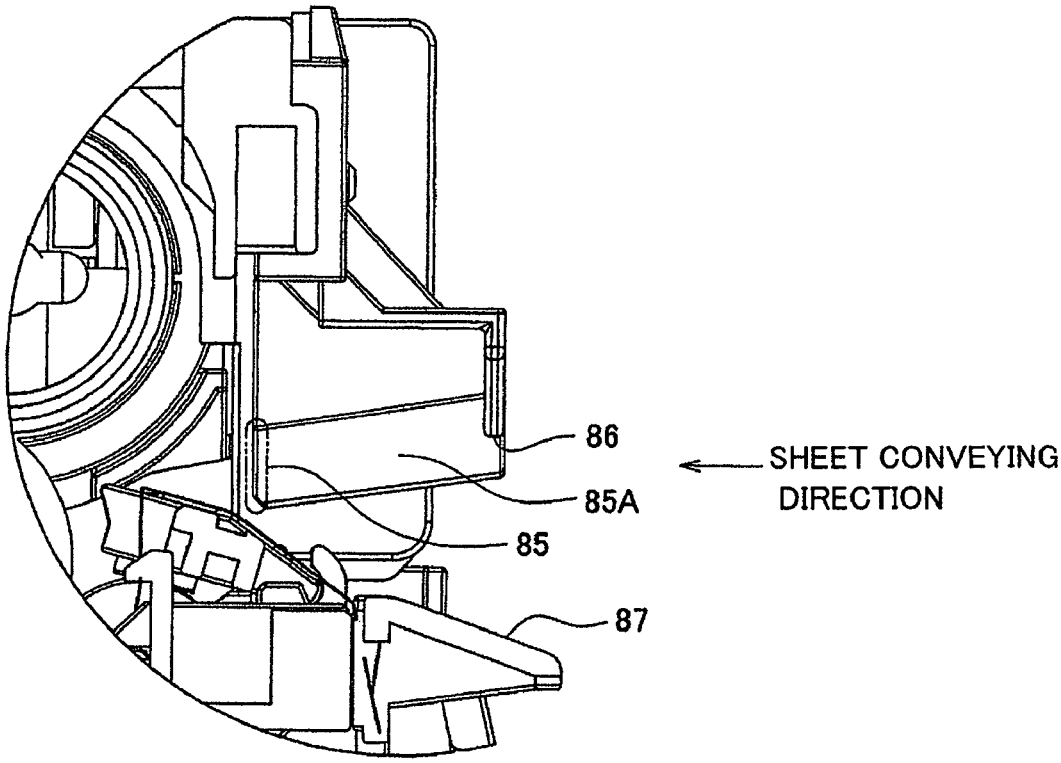
FIG. 8 is an enlarged view of a region C in FIG. 7.

As shown in FIGS. 4 and 8, first guiding surfaces 85A are formed on the upstream side of the first restraining parts 85 in the sheet-conveying direction. The first guiding surfaces 85A are positioned so as to contact the sheet with an arbitrary region of the first guide surface 85A within a prescribed range from the upstream side to the downstream side of the sheet-conveying path L and functions to guide the leading edge of the sheet discharged from the conveying unit 30 (image-forming unit 10) toward the nip point 84.

The "prescribed range" is a range sufficient for redirecting the leading edge of the sheet toward the nip point 84. Hence, portions of the first restraining parts 85 that contact the conveyed sheet of sheet (portions indicated by two dotted chain line in FIGS. 4 and 8) are configured of surfaces formed continuously with the first guiding surfaces 85A and are positioned on the downstream end of the first guiding surfaces 85A in the sheet-conveying direction.

Since the first restraining part 85 and the first guiding surface 85A form an integrated continuous surface with no borders, the leading edge of the sheet discharged from the conveying unit 30 is guided to the first restraining part 85 by the first guiding surface 85A.

As shown in FIGS. 4 and 8, the second restraining parts 86 are positioned at positions corresponding to the upstream ends of the first guiding surfaces 85A in the sheet-conveying direction and at positions offset from the first guiding surfaces 85A (first restraining parts 85) toward the widthwise center thereof. Accordingly, the second restraining parts 86 are positioned upstream of the first restraining parts 85 in the sheet-conveying direction.

The heating roller 81 is subjected to a crowning process to form the inflection point and widthwise edge portions. However, since the surface of the pressure roller 82 is elastically deformable, the leading edge of the sheet is curved along the shape of the heating roller 81 when the heating roller 81 and pressure roller 82 nip the leading edge portion.

In other words, when nipped by the fixing unit 80, the sheet is curved to form a convex shape convexing upward. A feeding speed of widthwise center of the sheet is slower than that of edge of the sheet because of difference in diameter between the widthwise center portion of the heat roller and the widthwise edge portion thereof. Thus, the degree of the curvature is greater the further upstream from the nip point 84.

Therefore the regions of the first restraining parts 85 contacting the sheet (unless otherwise specified, these regions will be referred to as the first restraining parts 85 below) and the regions of the second restraining parts 86 contacting the sheet (unless otherwise specified, these regions will be referred to as the second restraining parts 86 below) are both linear regions extending in the width direction, as shown in FIG. 5. Further, when viewed along the sheet-conveying direction, these regions are shaped so as to sloped in the direction the same as the sloping direction of the sheet at both widthwise edges.

More specifically, the first and second restraining parts 85 and 86 are sloped relative to the horizontal so that the widthwise center sides are higher than the widthwise ends sides. While the first and second restraining parts 85 and 86 are linearly sloped, the slopes may be formed in a gradually curved shape that follows the curved shape of the sheet.

The "sloped in the direction the same as the sloping direction of the sheet" indicates that the direction of slope in the first and second restraining parts 85 and 86 falls within a range of about ±15 degrees the sloping direction of the sheet at each positions corresponding to the first and second restraining parts 85 and 86.

Since the first and second restraining parts 85 and 86 are offset from each other in the sheet-conveying direction, the sloping direction of the sheet differs from the area in contact with the first restraining parts 85 and the area in contact with the second restraining parts 86. Each sloping direction each of the areas of the first and second restraining parts 85 and 86 that contact the sheet is set within a range of about ±15 degrees with respect to the sloping direction of the sheet.

If no guiding members are provided for guiding the sheet discharged from the conveying unit 30 until the leading edge of the sheet contacts the first guiding surfaces 85A, there is a danger that the leading edge of the sheet could separate from the conveying belt 33 and be affected by the force of gravity, vibrations, airflows, before contacting the first guiding surfaces 85A. As a result, the leading edge may be deviated vertically relative to the discharge direction D.

Figure 7:
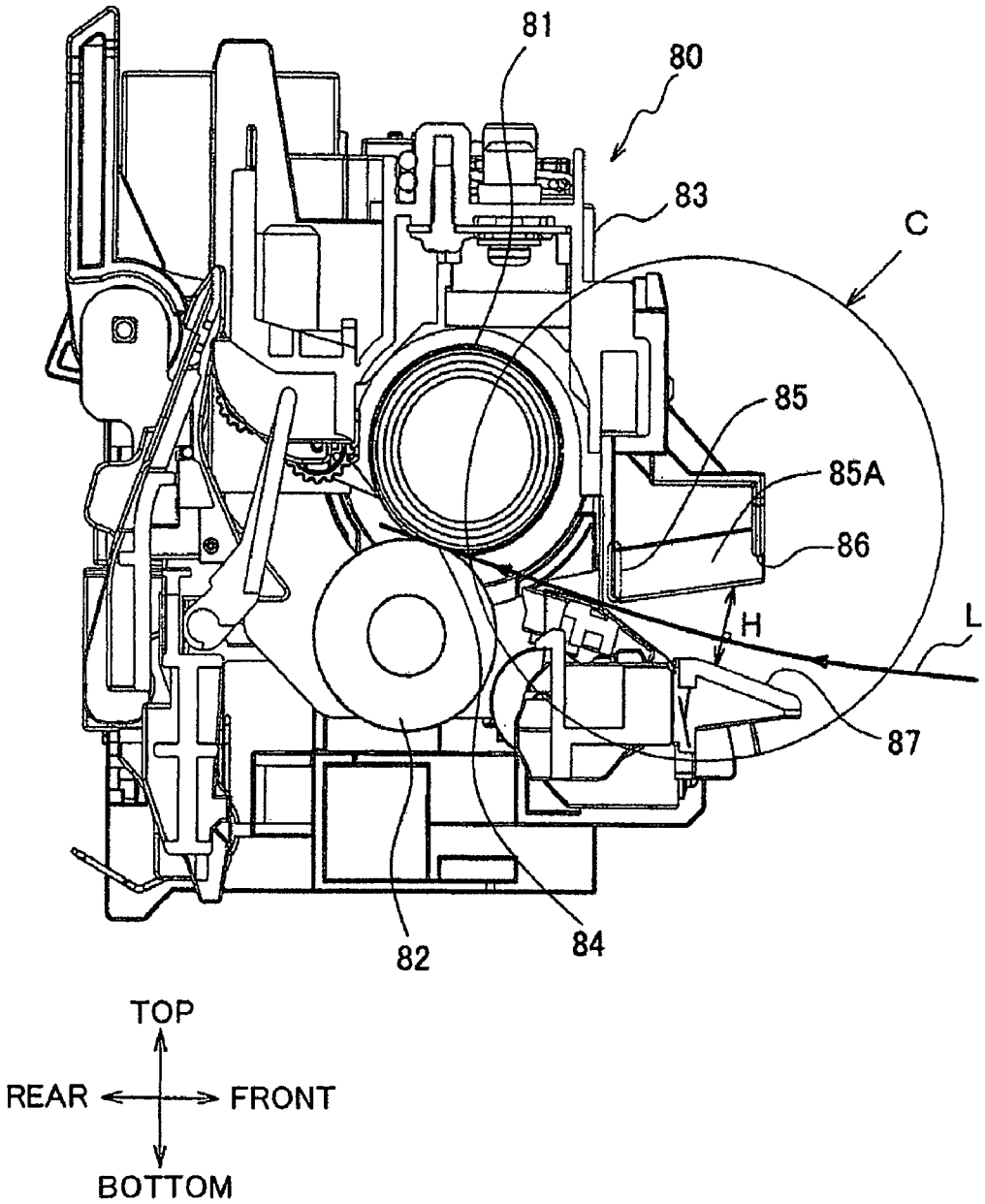
FIG. 7 is a cross-sectional view taken along a plane VII-VII in FIG. 5.

To avoid this deviation, second guiding surfaces 87 are disposed on the opposite side of the sheet-conveying path L from the first guiding surfaces 85A, as shown in FIGS. 7 and 8. The first guiding surfaces 85A and the second guiding surfaces 87 are sloped along the sheet-conveying path L so that a distance H between the first guiding surfaces 85A and second guiding surfaces 87 becomes narrower toward the nip point 84.

Further, since the vertically direction amount of the leading edge of the sheet relative to the discharge direction D becomes smaller toward the conveying belt 33, there is little need to provide a guiding surface similar to the first guiding surfaces 85A for the second restraining parts 86 provided closer to the conveying belt 33 than the first restraining parts 85. Hence the second restraining parts 86 are shaped to contact the sheet with less surface contact area than that of the first guiding surfaces 85A.

The distance S1 between first restraining parts 85 is set greater than the distance S2 between the second restraining parts 86 as shown in FIG. 5. Therefore, the second restraining parts 86 can restrain the trailing edge of a smaller size sheet from flipping upward.

Since the width dimension of the smaller size sheet (hereinafter referred to as "small sheet") is naturally less than the width dimension of a larger size sheet (hereinafter referred to as "large sheet"), the first restraining parts 85 do not contact the small sheet.

On the other hand, the first restraining parts 85 restrain the trailing edge of large sheet from flipping upward. However, since the distance S2 between the second restraining parts 86 is smaller than the distance S1 between the first restraining parts 85, there is potential for the second restraining parts 86 to contact the large sheet.

However, since the nip point 84 of the fixing unit 80 is offset vertically from the discharge plane in the discharge direction D in which sheet is discharged from the image-forming unit 10 (conveying unit 30). Thus, when the leading edge of the sheet is nipped at the nip point 84, the upstream side and downstream sides of the sheet are offset vertically from each other with respect to the discharge plane in the discharge direction D.

Figure 10:
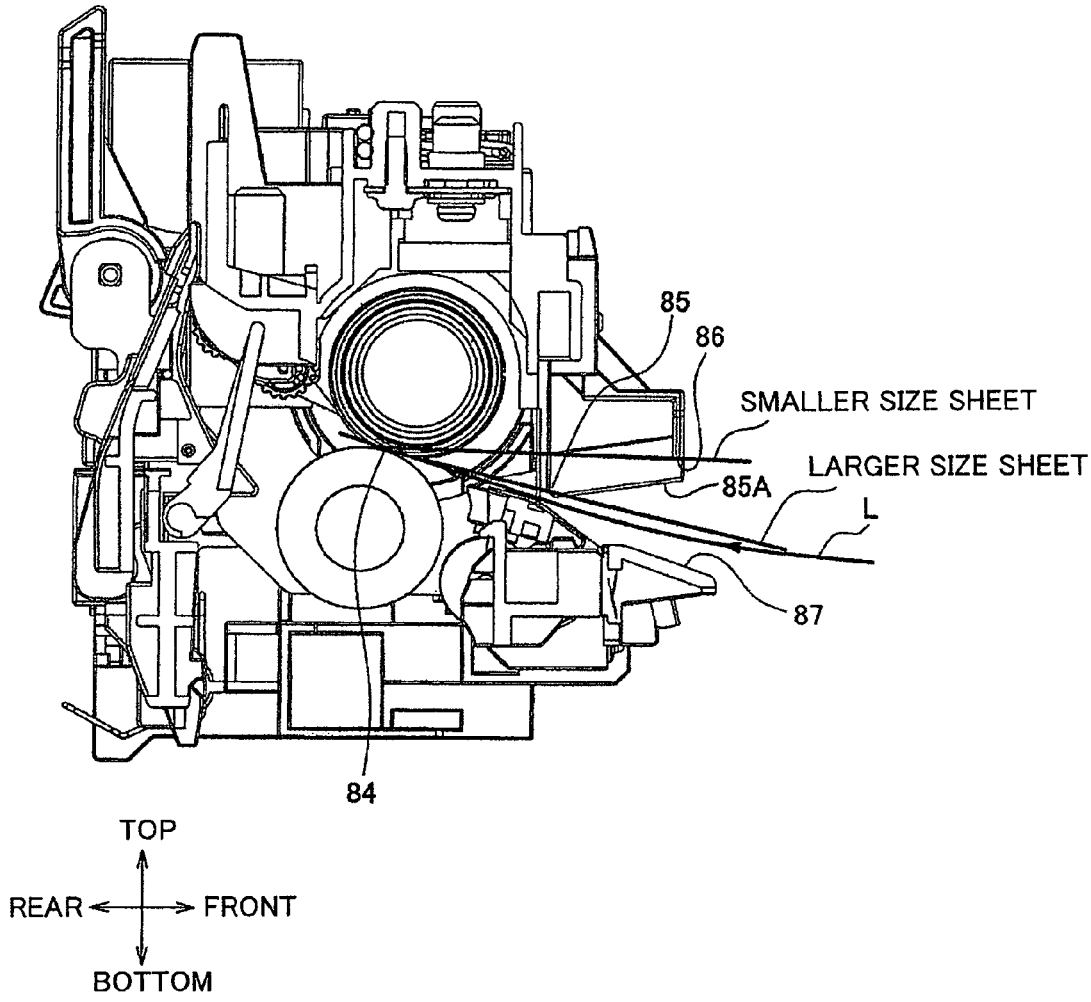
FIG. 10 is a side view showing an essential portion of the image-forming device according to the embodiment.

Therefore, by disposing the first and second restraining parts 85 and 86 at positions offset from each other in the sheet-conveying direction. The first and second restraining parts 85 and 86 are also offset vertically from each other relative to the sheet. Accordingly, the second restraining parts 86 do not contact the sheet when the first restraining parts 85 are in contact with the sheet, as illustrated in FIG. 10. Hence, the image-forming device 1 effectively restrains the trailing edge of the sheet from rising upward regardless of the kind of the sheets.

Further, in order to reduce the front-to-rear dimensions of the image-forming device 1 and convey the sheet discharged from the fixing unit 80 along a substantially 180 degree U-shaped path leading upward up to the discharge tray 52, the nip point 84 is set above the discharge plane in the discharge so that the sheet has already been detected upward on the upstream side of the fixing unit 80.

However, it is difficult with above compact construction to effectively restrain the trailing edge of the sheet from rising upward for a plurality of types of the sheet.

Therefore, the above-described first and second restraining parts 85 and 86 are effective for the image-forming device having a compact front-to-rear dimension and providing the U-shaped path.

When the first and second restraining parts 85 and 86 are provided along way of the sheet-conveying path L leading from the image-forming unit 10 to the fixing unit 80, there is some worry that the length of the sheet-conveying path L will be provided.

To minimize the size of the image forming device, it is desirable to position the first and second restraining parts 85 and 86 as close as possible to the fixing unit 80. However, when the first restraining parts 85 are excessively adjacent to the fixing unit 80, the leading edge of the sheet may collide with the first restraining parts 85 and be diverted in a direction not leading to the nip point 84.

To avoid this problem, the above-described first guiding surfaces 85A is provided for guiding the sheet upstream of the first restraining parts 85 toward the first restraining parts 85. Accordingly, the first guiding surfaces 85A can introduce the leading edge of the sheet into the first restraining parts 85 thereby guiding the leading edge toward the nip point 84.

When viewed along the sheet-conveying 3Q direction, the first and second restraining parts 85 and 86 are sloped in the same direction as the sloping direction of the sheet at both widthwise ends thereof. Therefore, the first and second restraining parts 85 and 86 can effectively restrain the trailing edge of the sheet without applying unnecessary force to the sheet.

Various modifications are conceivable. For example, in the above-described embodiment, the discharge direction D in which sheet is discharged from the conveying unit 30 is aligned roughly with the horizontal direction. However, the discharge direction D can be aligned with the vertical direction. In this case, the nip point 84 is offset horizontally relative to the discharge direction D.

Further, in the embodiment described above, the nip point 84 is offset above the discharge direction D, but nip point 84 may be offset below the discharge direction D.

Further, in the embodiment described above, the first and second restraining parts 85 and 86 are disposed on the casing 83 of the fixing unit 80. However, the first and second restraining parts can be provided to a portion other than the casing 83 as long as the first and second restraining parts 85 and 86 are provided along the sheet-conveying path L between the fixing unit 80 and the image-forming unit 10.

Further according to the exposure device in the above-described embodiment, the photosensitive drums 71 is exposed to laser beam scanning along the surface thereof. Instead of this arrangement, a plurality of LEDs can be arrayed along the axial direction of the photosensitive drums 71, and the photosensitive drums 71 may be exposed by flashing the LEDs.

While the invention has been described in detail with reference to specific embodiment thereof, it would be apparent to those skilled in the art that various modifications may be made therein without departing from the spirit of the invention, the scope of which is defined by the attached claims.

What is claimed is:

1. An image-forming device for forming an image on a recording sheet including a first recording sheet having a first width and a second recording sheet having a second width narrower than the first width, the recording sheet defining a width in a direction perpendicular to a sheet conveying direction, the device comprising:

an image-forming unit that forms a developing agent image on the recording sheet;

a fixing unit comprising a heating roller that heats the recording sheet discharged from the image-forming unit, and a pressure roller that presses the recording sheet against the heating roller, the heating roller and the pressure roller providing a nip point where the recording sheet is nipped therebetween, the nip point being offset in a thickness direction of the recording sheet from a plane along which the recording sheet is discharged from the image-forming unit, a sheet conveying path being provided from the image-forming unit to the fixing unit;

a pair of first guides disposed on the conveying path and configured to contact with an image-forming side of the first recording sheet at both widthwise edges thereof and separate from an image-forming side of the second recording sheet, for restraining the first recording sheet from being displaced toward the image-forming side; and a pair of second guides disposed on the conveying path and configured to contact with the image-forming side of the second recording sheet at both widthwise edges thereof and separate from the image-forming side of the first recording sheet, for restraining the second recording sheet from being displaced toward the image-forming side, a distance between the pair of first guides in the widthwise direction being greater than a distance between the pair of second guides in the widthwise direction, and the pair of second guides being offset from the pair of first guides in the sheet conveying direction.

2. The image-forming device according to claim 1, wherein the nip point is offset above the plane along which the recording sheet is discharged from the image-forming unit; and wherein the pair of second guides are disposed upstream of the pair of first guides in the sheet conveying direction.

3. The image-forming device according to claim 2, further comprising an introducing portion having an introducing surface that contacts the image forming side of the first recording sheet at an area upstream of the pair of first guides for guiding the first recording sheet discharged from the image-forming unit to the pair of first guides.

4. The image-forming device according to claim 3, wherein the pair of first guides have pair of first guide surfaces in contact with the image-forming side of the first recording sheet, and wherein the introducing surface is continuous with the pair of first guide surfaces.

5. The image-forming device according to claim 3, wherein the introducing surface has an upstream side in the sheet conveying direction at a position the same as a position of the pair of second guides.

6. The image-forming device according to claim 3, wherein the pair of second guides provide a contact surface area in contact with the second recording sheet, the contact surface area being smaller than an area of the introducing surface.

7. The image-forming device according to claim 1, wherein the heating roller, and the pressure roller are shaped to provide an arcuate shape to the first recording sheet and the second recording sheet in which a widthwise center portion of the recording sheet is in conformance with an inflection point and widthwise edge portions are sloped, and wherein the pair of first guides have a pair of first contact surfaces configured to contact with the first recording sheet, and the pair of second guides have a pair of second contact surfaces configured to contact with the second recording sheet, the pair of first contact surfaces and the pair of second contact surfaces being sloped in a direction the same as a sloping direction of the recording sheet at the widthwise edge portions.

8. The image-forming device according to claim 1, wherein the image-forming unit further comprises a photosensitive unit that carries a developing agent image, and comprising a plurality of photosensitive members juxtaposed in the sheet conveying direction;

a charging unit that applies a charge to the plurality of photosensitive members; and a sheet conveying mechanism comprising an endless belt stretched under tension and having a one way running section, and a pair of rollers for driving the endless belt in the sheet conveying direction at the one way running section, the plurality of photosensitive members being positioned in confrontation with the one way running section; and wherein the image-forming device further comprises a redirecting section that redirects the recording sheet discharged from the fixing unit in a discharging direction toward a direction opposite to the discharging direction.

9. The image-forming device as claimed in claim 1, wherein the image-forming unit comprises an electro-photographic type image-forming unit.

10. The image forming device as claimed in claim 1, wherein the pair of first guide members are only disposed at widthwise edges of the first recording sheet.

11. The image forming device as claimed in claim 1, wherein the pair of second guide members are offset above the pair of first guide member.

12. The image forming device as claimed in claim 1, wherein the pair of first guide members are disposed outside of the second recording sheet in the widthwise direction.

* * * * *